US008511029B2

(12) United States Patent
Hansen

(10) Patent No.: US 8,511,029 B2
(45) Date of Patent: Aug. 20, 2013

(54) SURFACE REPAIR PATCH

(76) Inventor: Daniel Hansen, Los Angeles, CA (US)

( * ) Notice: Subject to any disclaimer, the term of this patent is extended or adjusted under 35 U.S.C. 154(b) by 0 days.

(21) Appl. No.: 13/406,976

(22) Filed: Feb. 28, 2012

(65) Prior Publication Data

US 2012/0152439 A1 Jun. 21, 2012

Related U.S. Application Data

(63) Continuation-in-part of application No. 12/754,248, filed on Apr. 5, 2010, now abandoned.

(51) Int. Cl.
*E04G 23/02* (2006.01)

(52) U.S. Cl.
USPC ..... 52/514; 52/514.5; 52/742.14; 52/746.1; 428/63; 428/138; 156/94

(58) Field of Classification Search
USPC ..... 52/514, 514.5; 428/63
See application file for complete search history.

(56) References Cited

U.S. PATENT DOCUMENTS

| | | | | |
|---|---|---|---|---|
| 2,410,865 | A | | 11/1946 | Brown |
| 3,043,298 | A | | 7/1962 | Brickman et al. |
| 3,874,505 | A | | 4/1975 | Mirarchi |
| 3,945,842 | A | | 3/1976 | Green |
| 4,135,017 | A | | 1/1979 | Hoffman |
| 4,193,243 | A | | 3/1980 | Tiner |
| 4,285,183 | A | | 8/1981 | Condit |
| 4,335,554 | A | | 6/1982 | Nicholson |
| 4,353,510 | A | | 10/1982 | Damke et al. |
| 4,354,332 | A | | 10/1982 | Lentz |
| 4,381,769 | A | | 5/1983 | Prahl |
| 4,406,107 | A | | 9/1983 | Schoonbeck |
| 4,460,420 | A | * | 7/1984 | Estrada ..... 156/64 |
| 4,471,594 | A | | 9/1984 | Doyle |
| 4,620,407 | A | | 11/1986 | Schmid |
| 4,632,790 | A | * | 12/1986 | Bernard ..... 264/36.2 |
| 4,707,391 | A | | 11/1987 | Hoffman, Sr. |
| 4,776,906 | A | | 10/1988 | Bernard |
| 4,959,251 | A | | 9/1990 | Owens et al. |
| 4,984,566 | A | | 1/1991 | Sekine et al. |
| 4,989,385 | A | | 2/1991 | McCullough |
| 5,033,949 | A | | 7/1991 | Jewett |
| 5,075,149 | A | | 12/1991 | Owens et al. |
| 5,269,861 | A | | 12/1993 | Gilbreath |
| 5,298,099 | A | | 3/1994 | Hoffmann, Sr. |
| 5,620,768 | A | | 4/1997 | Hoffman |
| 5,640,820 | A | | 6/1997 | Wood |
| 5,687,528 | A | | 11/1997 | Rouch |
| 5,820,958 | A | | 10/1998 | Swallow |

(Continued)

FOREIGN PATENT DOCUMENTS

WO 2007/127701 A2 * 11/2007

*Primary Examiner* — Robert Canfield
(74) *Attorney, Agent, or Firm* — Marc E. Hankin; Jimmy Sauz; Kevin Schraven

(57) ABSTRACT

This invention is a method and apparatus for repairing a hole in a surface with a perforated repair patch. The repair patch, which is affixed to and substantially cover over the hole, is indented inwards by applying cement compound into its perforations and pushing the repair patch into the hole as the cement compound hardens. A layer of drywall compound is then applied over the indented repair patch to smooth it with the rest of the wall. The perforated repair patch may include an additional layer of mesh sheet material to minimize cracking of the drywall compound.

9 Claims, 14 Drawing Sheets

(56) References Cited

U.S. PATENT DOCUMENTS

| | | | | |
|---|---|---|---|---|
| 5,925,204 | A | 7/1999 | Hoffmann, Sr. | |
| 5,960,603 | A | 10/1999 | Redden | |
| 6,071,833 | A | 6/2000 | D'Alisa et al. | |
| 6,162,525 | A | 12/2000 | Amy | |
| 6,231,949 | B1 | 5/2001 | Hoffman, Sr. | |
| 6,317,952 | B1 | 11/2001 | Vogt | |
| 6,378,263 | B1 | 4/2002 | Sobers | |
| 6,508,040 | B2 | 1/2003 | Nelson | |
| 6,607,621 | B1 | 8/2003 | Swanson et al. | |
| 6,627,292 | B1 * | 9/2003 | Hoffmann, Sr. | 428/139 |
| 6,852,408 | B2 | 2/2005 | Hansen et al. | |
| 7,121,054 | B2 | 10/2006 | Shock | |
| 7,380,382 | B2 | 6/2008 | Hansen | |
| 7,971,405 | B2 * | 7/2011 | Hansen | 52/514 |
| 8,381,474 | B2 * | 2/2013 | Lewis | 52/514 |
| 2003/0181114 | A1 | 9/2003 | Newton et al. | |
| 2006/0059829 | A1 | 3/2006 | Flynn | |
| 2006/0096220 | A1 * | 5/2006 | Greer et al. | 52/514 |
| 2007/0087151 | A1 * | 4/2007 | Hoffmann et al. | 428/40.1 |
| 2008/0115443 | A1 * | 5/2008 | Hathaway | 52/514 |
| 2011/0239577 | A1 * | 10/2011 | Hansen | 52/514 |

* cited by examiner

SURFACE REPAIR PATCH

CROSS-REFERENCES OF RELATED APPLICATIONS

This application is a Continuation-in-Part of allowed U.S. Non-Provisional patent application Ser. No. 12/754,248, filed on Apr. 5, 2010, now abandoned, entitled "A Mechanically Tensioned Wall Patch", by inventor Daniel R. Hansen, the contents of which are expressly incorporated herein by this reference, and to which priority is claimed.

FIELD OF INVENTION

This invention relates to the method and apparatus for repairing a hole in a sheet, plate, board, fiberglass, wood, gypsum board, or drywall, with an adhesive repair patch. More particularly, the invention relates to a method and apparatus of indenting a repair patch into the hole to be patched.

BACKGROUND

Since the advent of the drywall, and its prolific use in the construction of structures, methods and devices have been created to repair damaged portions of a drywall. Generally, there are two common types of reparable damage to a drywall: a small hole or crack; or a large hole. Large holes are typically repaired by cutting out the damaged section of the wall, placing a back board behind the cut-out hole and filling the cut-out hole with a comparable sized piece of drywall. The edges of the cut-out are then taped with paper drywall tape or fiberglass tape, and filled in and covered with drywall compound.

Very small holes and cracks may often be repaired with just the use of drywall compound, by layering the drywall compound over the hole or crack and then sanding it down to smooth it with the rest of the wall.

For holes that are too large to use just the drywall compound or too small to warrant the use of the cut-out and replace method, a mesh repair patch, or a mesh laminated and centered onto a smaller piece of metal, as disclosed in U.S. Pat. No. 4,135,017, issued to Hoffman, is frequently used. A mesh repair patch is a small piece of mesh, typically made out of round fiberglass threads, which is placed over the hole in the drywall. The mesh repair patch provides a workable surface for the drywall compound to adhere to in repairing the damage, but can leave an unsightly bulge, or fall away completely from the wall due to the weight of the drywall compound. Alternatively, metal laminate plates are rigid enough to support more weight, but leave an unsightly bulge that is difficult to float out and hide due to the increased thickness of the metal.

There are numerous references that disclose devices and methods for repairing holes in walls, boards, sheets, plates, fiberglass, wood, gypsum board, or drywall using a mesh repair patch. For example, U.S. Pat. No. 7,380,382 ("the '382 patent"), issued to Daniel R. Hansen, the same inventor of the present invention, the contents of which are expressly incorporated herein by this reference as though set forth in its entirety, discloses a laminate mesh repair patch that has an adhesive located on one side of the fiberglass mesh adhered and centered onto a smaller separate sheet of dry, water hardenable cement on the front. The mesh repair patch of the '382 patent is placed over the hole, the sides of the patch adhere to the wall immediately adjacent to the hole, and the cement is wetted, allowed to set for about 5 minutes becoming partially rigid, but still movable, and then pushed inward to form an indentation. After the indentation sets relatively hard, drywall compound is applied to make a smooth repair. The partially rigid cement on the front of the mesh repair patch allowed the mesh laminate to be manually indented into the hole by pushing it inward with a hand or finger.

Although the '382 patent was a vast improvement over using the standard mesh repair patch, or metal laminate patches, without the dry, water hardenable cement on the front, it did not entirely overcome the problem of providing a repair patch devoid of an unsightly bulge. Specifically, the '382 patent had a mesh repair patch thinner than the popular metal laminate patch, but thicker than a fiberglass mesh patch devoid of a metal plate. The '382 patent requires that the user spray water over the patch once it is affixed over the hole and onto the wall, and rubbed with a hand to mix the plaster. With the addition of water, the '382 patch will sometimes slide off the wall, or in cold weather, will not stick at all and if the user forgets to indent the patch, the repair process must start all over. Also, if the plaster on the patch is not wetted and rubbed properly, a larger, unsightly bulge may be created. In addition, the water can cause the '382 patch to be messy and typically requires the user to purchase a water spray bottle. Finally, it can take 20 or 30 minutes, depending on atmospheric conditions, for the patch disclosed in the '382 patent to set hard enough to complete the repair. This is a significant downside for professionals in need of an instant repair.

Moreover, several references, including U.S. Pat. No. 4,406,107 ("the '107 patent"), U.S. Pat. No. 6,317,952 ("the '952 patent"), and U.S. Pat. No. 5,033,949 ("the '949 patent"), disclose wall repair devices that provide a stable surface on which to apply a drywall compound to repair a hole in a wall. However, none of these references incorporate an easy to use mesh repair patch and each and every one of these references involves the use of a very complex device or method that is difficult to use or perform. For example, the '107 patent, issued to Schoonbeck discloses a wall repair device that is comprised of two discs connected with a center bolt and nut. The larger of the two discs must be larger than the hole to be repaired and is adhered to the back of the wall. The smaller disc must be smaller than the hole to be repaired. The smaller disc is positioned along the bolt and is locked in place just rearward of the hole. The front and smaller disc acts as a stable platform for drywall compound to be applied. Although the device disclosed in the '107 patent could potentially aid in the repair of a drywall hole, the device is very complex and is extremely limited. Specifically, there is no easy way to modify the discs to fit the randomly sized hole that may need to be repaired. Additionally, it is hard to imagine how the large disc fits through the hole in the first place since it must necessarily be larger than the hole.

The '952 patent discloses a device that includes a flexible plastic plate, which is bigger than the hole to be repaired and is pushed to the inside of the wall and then pulled back against the back side of the wall using a plastic zip key like device. The zip key is attached to a plastic rod, which is positioned on the outside of the wall and securely holds the plate in place. The problem with this device is that the plastic rod is in the way when the user fills the hole with plaster or drywall compound. Additionally, once the drywall compound hardens, the plastic zip key must be cut away as close to the hardened plaster as possible and removed from the patching assembly along with the plastic rod. Accordingly, an additional coat of drywall compound is required to complete the repair and cover the zip key.

The '949 patent discloses a back disc that is held in place in a hole by a bolt while drywall compound is filled in the hole. Before the compound is set, a front dam is attached to the bolt, and the back disc is forced forward, which causes the compound to press forward against the dam. The problem with this device is that it is extremely complicated to use and requires the user to hold the back in place while the drywall compound is applied.

Furthermore, U.S. Pat. No. 5,620,768 ("the '768 patent), issued to Hoffman, discloses a plastic repair patch, which functions as a rigid substrate to support the weight of a joint compound. The '768 repair patch is typically adhered onto a hole in the wall for repair and preferably includes a plurality of holes on which to apply a drywall compound. While the '768 repair patch may be "flexible" and "deformable" to conform onto uneven surfaces, the '768 repair patch remains too rigid to form an indent. This often leaves an unsightly bulge on the wall, which also remains to be a significant downside for professionals.

Finally, U.S. Pat. No. 7,971,405 ("the '405 patent"), issued to Daniel R. Hansen, the same inventor of the present invention, the contents of which are expressly incorporated herein by this reference as though set forth in its entirety, discloses a self-adhesive wall repair patch. The '405 repair typically adheres onto a hole in the wall for repair and generally uses water to create a semi-rigid plastered area. After approximately ten to twenty minutes, the user presses the plastered area to form an indent. A fast-setting patching compound is then added to fill the indented area of the repair patch. Because the '405 repair patch relies on a chemical reaction to form the indent, application of the '405 repair patch often requires skill to moisten and mix the plaster and may become messy when sprayed with water. The user of the '405 repair patch also often has to wait approximately ten to twenty minutes before a repair can be made.

Thus, what is needed is to provide a surface repair patch that is less complex than the prior art; much easier to use; and is cost-effective in repair.

SUMMARY OF THE INVENTION

To minimize the limitations in the prior art, and to minimize other limitations that will become apparent upon reading and understanding the present specification, the present invention is a method and apparatus of indenting a repair patch into the hole to be patched.

One embodiment of the present invention is a surface repair patch comprising: a patch; wherein the patch is affixed to an outer edge of a hole in a surface, such that the patch substantially covers the hole. The patch indents and remains substantially indented when a user applies a cement compound onto the patch. Preferably, the patch includes one or more perforations; wherein the one or more perforations receive the cement compound, such that a portion of the cement compound passes through the one or more perforations. Preferably, the surface repair patch further comprises of: a mesh sheet; wherein the mesh sheet should affix to and substantially cover the patch. The patch is preferably constructed out of a pliable sheet material. The mesh sheet is preferably constructed out of a fiberglass thread material. The patch should include an adhesive on at least one side of the patch. The patch may be an aluminum foil. The surface is typically a drywall. The hole may comprise a channel cut in the drywall. A drywall compound should be applied to the indented patch.

Another embodiment of the present invention is a surface repair patch comprising: a patch; and a mesh sheet. The mesh sheet is affixed to and substantially covers the patch; wherein the patch includes one or more perforations. The patch is affixed to an outer edge of a hole in a surface, such that the patch substantially covers the hole. The patch indents and remains substantially indented when a user applies a cement compound onto the patch. A drywall compound is applied to the patch and the mesh sheet. The patch is constructed out of a pliable sheet material. The patch includes an adhesive on at least one side of the patch. The mesh sheet is constructed out of a fiberglass thread material. The surface is a drywall; and the hole comprises a channel cut in the drywall.

Another embodiment of the present invention is a method of applying a repair patch to a hole in a surface, comprising the steps of: affixing a patch to an outer edge of a hole in a surface, such that the patch substantially covers the hole; wherein the patch includes one or more perforations; applying a cement compound to the patch, such that the cement compound passes through the one or more perforations; and indenting the patch by pushing the patch into the hole. Preferably, the patch includes a mesh sheet affixed substantially over the patch. Preferably, the patch is constructed out of a pliable sheet material. The mesh sheet is typically constructed out of a fiberglass thread material. Preferably, the patch includes an adhesive on at least one side of the patch. The method of applying a repair patch to a hole typically further comprising the step of: applying a drywall compound to the indented and partially rigid patch to form a smooth repair over the hole. The surface is preferably the drywall. Preferably, the patch is an aluminum foil. The hole may be comprised of a channel cut in a drywall.

Another embodiment of the present invention is a surface repair patch comprising: a patch; wherein the patch adheres to and substantially covers a front side of a hole in a surface. The patch automatically indents over the center of the hole from the pressure created by the action of the patching compound being pressed onto the patch due to the flexible, but semi-rigid nature of the patch. Because the patch is semi-rigid, it will hold the indented shape until the patching compound hardens. Preferably, the patch includes: one or more perforations; wherein the one or more perforations receive the cement compound, such that a portion of the cement compound being pressed onto the patch, flows through the one or more perforations and hardens. Preferably, the surface repair patch, further comprises: a mesh sheet; wherein the mesh sheet is affixed to and substantially covers the patch. The patch is preferably constructed out of a pliable sheet material, and the mesh sheet is preferably constructed out of a fiberglass thread material. The patch typically includes an adhesive on at least one side of the patch. The patch may be a material made of metal foil or another material with similar qualities to a metal foil or a combination of both. The surface is typically a drywall. The hole typically comprises a channel cut in the drywall. A drywall compound should be applied to the indented patch.

Another embodiment of the present invention is a surface repair patch comprising: a patch; and a mesh sheet. The mesh sheet is affixed to and substantially covers the patch. The patch with the affixed mesh sheet includes one or more perforations. The patch adheres to and substantially covers a front side of a hole in a surface. The one or more perforations receives a cement compound. The patch indents when a user pushes the patching compound onto the patch from the natural pressure one uses during application with a drywall knife. The indentation will hold its shape until the cement compound substantially hardens. A drywall compound is applied to the patch, and the patch is constructed out of a pliable sheet material. The patch includes, but is not limited to, an adhesive, or resin on at least one side of the patch. The mesh sheet is constructed out of a fiberglass thread material. The surface is a drywall; and the hole comprises a channel cut in the drywall.

Another embodiment of the present invention is a method of applying a repair patch to a hole in a surface, comprising the steps of: affixing a patch to a front side of a hole; wherein the patch includes one or more perforations; applying over the patch a cement compound, such that the cement compound flows through the one or more perforations; and indenting the patch by pushing a central portion of the patch into the hole from the natural pressure created from application with a drywall knife to form a concave portion of the patch in the hole. The repair patch preferably includes a mesh sheet affixed substantially over the patch. Preferably, the patch is constructed out of a pliable sheet material. The mesh sheet should be constructed out of a fiberglass thread material. The patch typically includes an adhesive type of material on at least one side of the patch. The method of applying a repair patch to a hole in a surface, typically further comprising the step of: after hardening of the cement compound, applying a drywall compound to the plaster filled indentation and tensioned patch to form a smooth finished wall surface over the hole and the patch. The surface is typically the drywall, and the patch should be a metal foil. Generally, the hole comprises a channel cut in a drywall.

Another embodiment of the invention is a surface repair patch comprising: a patch; and wherein the patch is affixed to an outer edge of a hole in a surface, such that the patch substantially covers the hole. The patch indents into the hole such that an indented portion of the patch is created; and wherein the indented portion of the patch remains substantially indented when a user applies a drywall compound to fill the indented portion. Preferably, the patch is constructed of foil. Preferably, the patch includes an adhesive on at least one side of the patch. Preferably, the surface repair patch further comprises a mesh sheet; wherein the mesh sheet is affixed to and substantially covers the patch. Preferably the foil is expandable foil. Preferably, the mesh sheet is constructed out of a fiberglass thread material. Preferably, the surface is a drywall. Preferably, the hole comprises a channel cut in the drywall.

Another embodiment of the invention is a surface repair patch, comprising: a patch; wherein the patch is affixed to an outer edge of a hole in a surface, such that the patch substantially covers the hole. The patch indents into the hole such that an indented portion of the patch is created; and wherein the indented portion of the patch remains substantially indented when a user applies a drywall compound to fill the indented portion. Preferably, the patch comprises of: a mesh sheet; an aluminum foil; and a stretchable plastic film; wherein the mesh sheet is affixed to and substantially covers a first side of the aluminum foil; and wherein the stretchable plastic film is affixed to and substantially covers a second side of the aluminum foil. Preferably, the stretchable plastic film includes an adhesive; wherein the adhesive affixes the patch onto the surface. Preferably, the mesh sheet is constructed out of a fiberglass thread material. Preferably, the stretchable plastic film is constructed out of a Saran® wrap material.

Another embodiment of the invention is a surface repair patch comprising a patch, wherein the patch is affixed to an outer edge of a hole in a surface, such that the patch substantially covers the hole; wherein the patch indents into the hole such that an indented portion of the patch is created; and wherein the indented portion of the patch remains substantially indented when a user applies a drywall compound to fill the indented portion. Preferably, the patch comprises of: a mesh sheet; an aluminum foil; and a stretchable plastic film; wherein the mesh sheet is preferably affixed to and substantially covers a first side (preferably front side) of the aluminum foil; and wherein the stretchable plastic film is preferably affixed to and substantially covers a second side (preferably back side) of the aluminum foil. Preferably, the stretchable plastic film includes an adhesive; and the adhesive preferably affixes the patch onto the surface. The mesh sheet may be constructed out of a fiberglass thread material. A thickness of the aluminum foil preferably is approximately between 0.02 to 0.04 inches.

It is an object of the present invention to overcome the limitations of the prior art.

Another object of this invention is to provide a wall patch that is simple, easy to use, professional grade, and inexpensive.

One of the problems that the present invention solves is how to immediately indent and hold steady a mesh wall patch that is strong enough to support the weight of a drywall compound so that it can be used to smoothly repair a hole in a surface, such as dry wall.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For instance, the term "drywall compound" refers to any substance that can be used to patch a hole in a wall or other surface, including, but not limited to, any putty, spackle, mud, joint compound, plastic, resin, plaster, veneer plaster, plaster of paris, or other mixture of water, limestone, expanded perlite, ethylene-vinyl acetate polymer, gypsum, and/or attapulgite.

Figure 1:
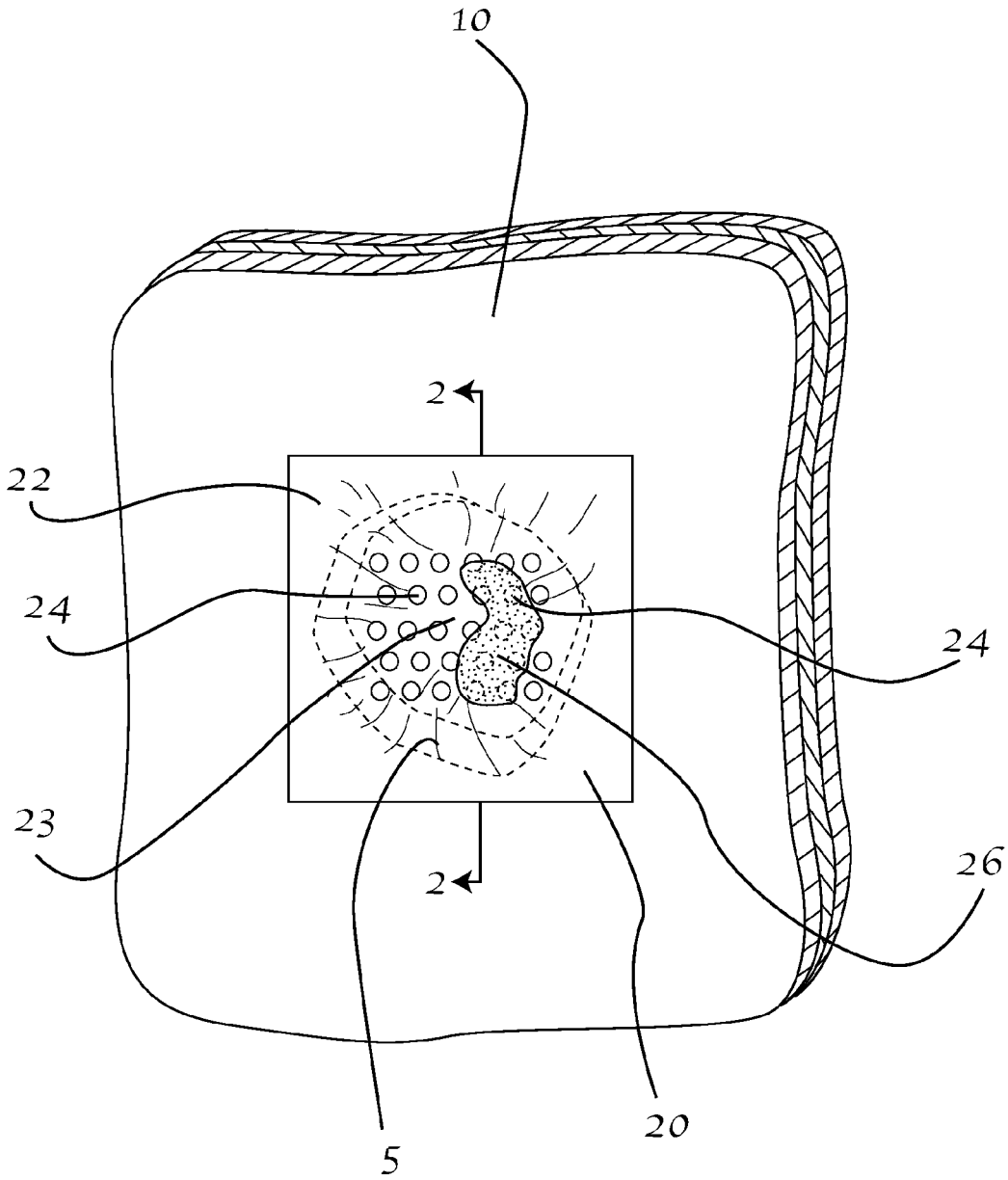
FIG. 1 is an illustration of a perspective view of one embodiment of the invention and shows the patch without a mesh sheet applied to a hole.

FIG. 1 is an illustration of a perspective view of one embodiment of the invention and shows the patch without a mesh sheet applied to a hole. As shown in FIG. 1, one embodiment of the invention may be a perforated surface repair patch for a hole 5 in wall 10 and may be comprised of a patch 20, adhesive 22, indent 23, perforations 24, and cement compound 26. The patch 20 is preferably a small piece of material affixed to a wall to conceal, reinforce, or repair a worn area, hole, or tear. The patch 20 may be constructed of any pliable, semi-rigid, or rigid material such as cloth, foil, metal, latex, textile fibers, fiberglass, polymers, expandable aluminum foil, aluminum, stretchable plastic (e.g., saran wrap), and the like. The patch 20 also may be constructed or laminated into several layers; wherein each layer, as discussed above, may be constructed in any pliable, semi-rigid, or rigid material such as cloth, foil, latex, textile fibers, fiberglass mesh, polymers, expandable aluminum foil, aluminum, stretchable plastic (e.g., saran wrap), and the like. Patch 20 is adhered, or otherwise affixed or attached, to the front surface, although any surface may be repaired, of the wall 10 along the outer edge or surface of the hole 5. Generally, a pressure sensitive adhesive is the preferred method to adhere, affix, attach, or connect the patch onto the wall or surface to be repaired, but it should be understood that any attachment or connection means may be used. Although FIG. 1 shows the patch to have perforations, it should be understood that the present invention may include a patch without perforations (shown in FIGS. 8 to 14).

FIG. 1 shows how patch 20 is adhesively affixed over hole 5 such that the entire hole is preferably covered. As shown in FIG. 1, patch 20 is preferably constructed out of a thin pliable sheet material. The patch 20 may be a pre-cut strip or cut from a large roll of sheet pliable material, and preferably includes perforations 24 configured to receive a cement compound 26. The cement compound is preferably any strong liquid or paste that indents the patch upon application for the purpose of allowing the patch 20 to remain indented until the plaster hardens, and may consist of drywall compound. With the patch in a held indented state, a user may create a smoother and faster repair to the hole by applying a drywall compound 30 (shown in FIG. 3) onto the indented patch 20 to complete the repair of the hole. Although only thirty perforations 24 are shown in FIG. 1, it should be understood that any number of perforations, or no perforations, may be utilized on the patch 20.

Preferably, the patch is made of thin, lightweight pliable sheet material such as aluminum foil or other pliable sheet metals, but it should be understood that the patch may be made from any natural or synthetic material, including but not limited to: metal; metal alloy; wood or other fibrous plant product such as hemp, paper, or cardboard; glass; composite materials such as graphite, fiberglass, boron, or aramid fibers; admixtures of plastic resins combined with metal, metal alloy, wood or other fibrous plant product, glass, or composite materials; plastic; animal materials such as wool, bone, or hardened leather; or any combination of these materials, without departing from the scope of the present invention.

Figure 2:
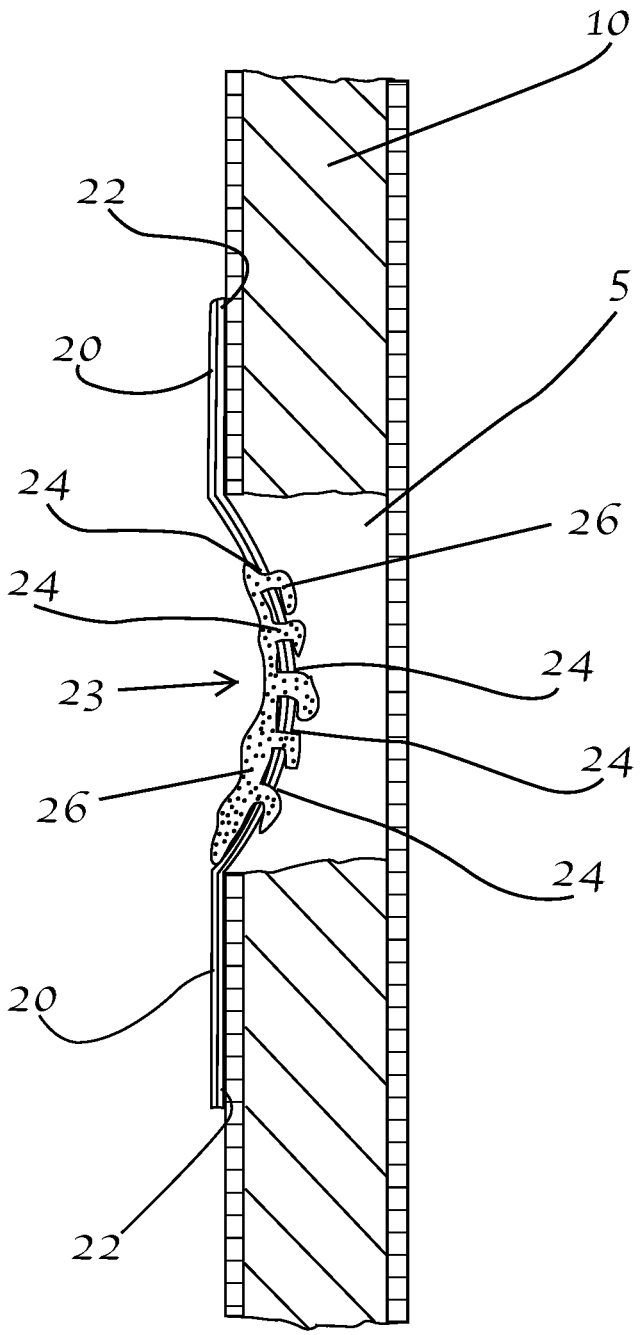
FIG. 2 is an illustration of a cross-section view of one embodiment of the invention without a mesh sheet and shows the patch indented with a cement compound after the first application of drywall compound has been applied only to the center of the patch.

FIG. 2 is an illustration of a cross-section view of one embodiment of the invention without a mesh sheet and shows the patch indented with a cement compound after the first application of drywall compound has been applied only to the center of the patch. As shown in FIG. 2, the perforated surface repair patch is preferably comprised of: a patch 20, adhesive 22, indent 23, perforations 24, and cement compound 26. FIG. 2 shows how the patch 20 is affixed to the wall 10 via adhesive 22. Patch 20 is preferably adhesively affixed to the front side of the wall 10, but any fastening mechanism may be used, including mechanical fastening mechanisms, such as pins, nails, or staples.

FIG. 2 also shows how the patch 20 is indented into the hole 5 via cement compound 26. After the cement compound 26 is applied onto the patch 20, portions of the drywall compound 26 preferably seep through the perforations 24. The cement compound 26 sets or hardens after a certain period of time to form a permanent indent 23 onto the patch 20.

Figure 3:
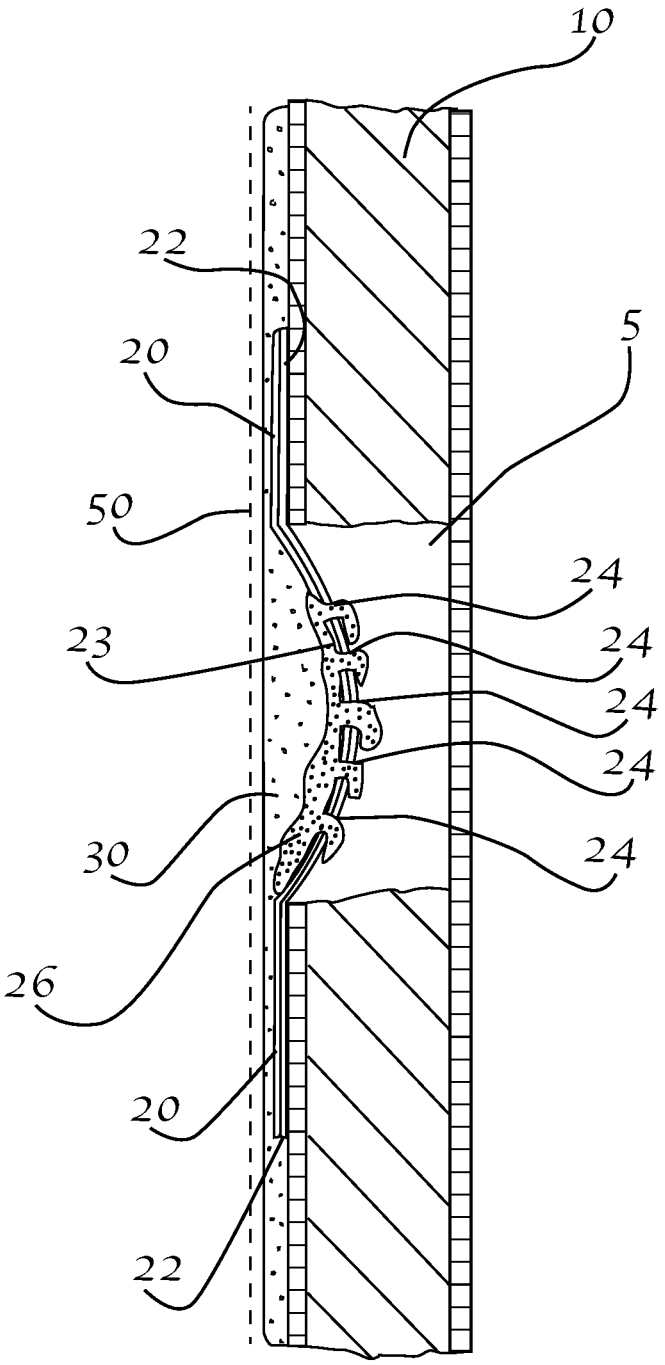
FIG. 3 is an illustration of a cross-section view of one embodiment of the invention without a mesh sheet and shows the patch indented after application of the drywall compound.

FIG. 3 is an illustration of a cross-section view of one embodiment of the invention without a mesh sheet and shows the patch indented after application of the drywall compound. As shown in FIG. 3, the perforated surface repair patch is preferably comprised of: a patch 20, adhesive 22, indent 23, perforations 24, cement compound 26, and drywall compound 30. FIG. 3 also shows how a drywall compound 30 may be smoothly applied to hole 5, completely repairing hole 5. The drywall compound 30 preferably covers patch 20 when applied, and typically, a layer of paint 50, which is not part of the claimed invention and is shown in broken-line form, is applied over the smooth drywall compound to complete the repair.

Figure 4:
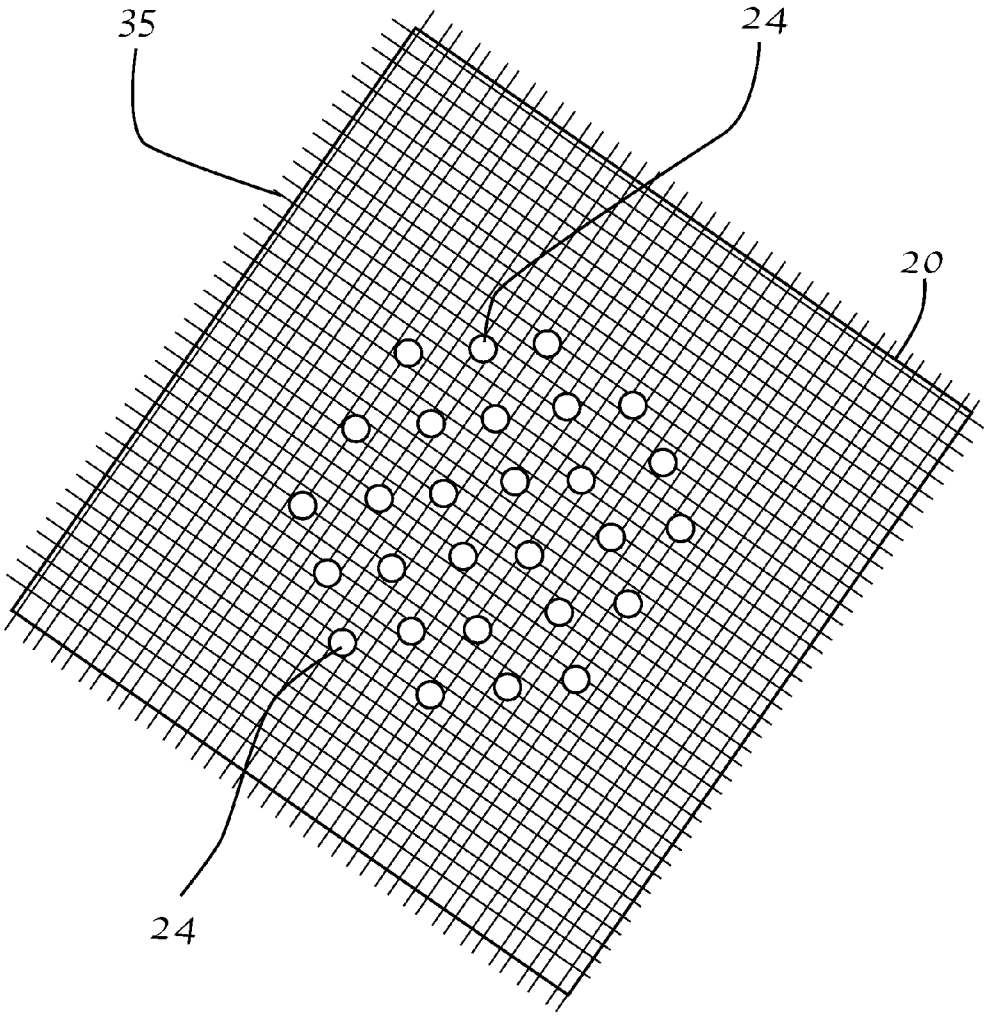
FIG. 4 is an illustration of a perspective view of one embodiment of the patch with a mesh sheet and shows mesh sheet affixed to the patch.

FIG. 4 is an illustration of a perspective view of one embodiment of the patch with a mesh sheet and shows mesh sheet affixed to the patch. As shown in FIG. 4, the patch with a mesh sheet preferably includes: a patch 20; perforations 24; and mesh sheet 35. The patch 20, as discussed above, is preferably constructed out of a thin pliable sheet or foil type material, such as aluminum, but may be constructed out of any other natural, synthetic, or man-made or non-manmade material. The perforations 24 are preferably holes in the patch 20, which allow cement compound 26 to seep through the patch 20, allowing a user to form an indent 23 as the cement compound 26 hardens.

The mesh sheet 35 is preferably constructed of fiberglass material and typically contains a permanent adhesive to adhere, affix, attach, or connect itself to the patch 20 and/or onto the wall or surface to be repaired. However, the mesh sheet 35 may be affixed via any mechanism, and may be made of any material such as solid non-mesh material without deviating from the scope of the invention. If the mesh sheet is a solid material, then it should have perforations, similar to perforations 24, which allow the cement compound to pass through the mesh sheet to the patch 20 and to the perforations 24. The mesh sheet 35 is typically affixed to the patch 20 to provide additional support for the drywall compound 30 to help minimize cracking and is preferably constructed out of fiberglass thread. The small holes that are within the mesh sheet 35 preferably allow the cement compound 23 to seep through to the patch 20 and to the perforations 24. Alternatively, the mesh sheet 35, even if mesh, may also have additional perforations similar perforations 24. Additionally, in a non-limiting example, mesh sheet 35 may also be drywall tape, tape, or reinforced tape. While FIG. 4 shows a patch 20 with a mesh sheet 35, it should be understood that the present invention allows the use of a patch 20 without utilizing a mesh sheet 35.

Figure 5:
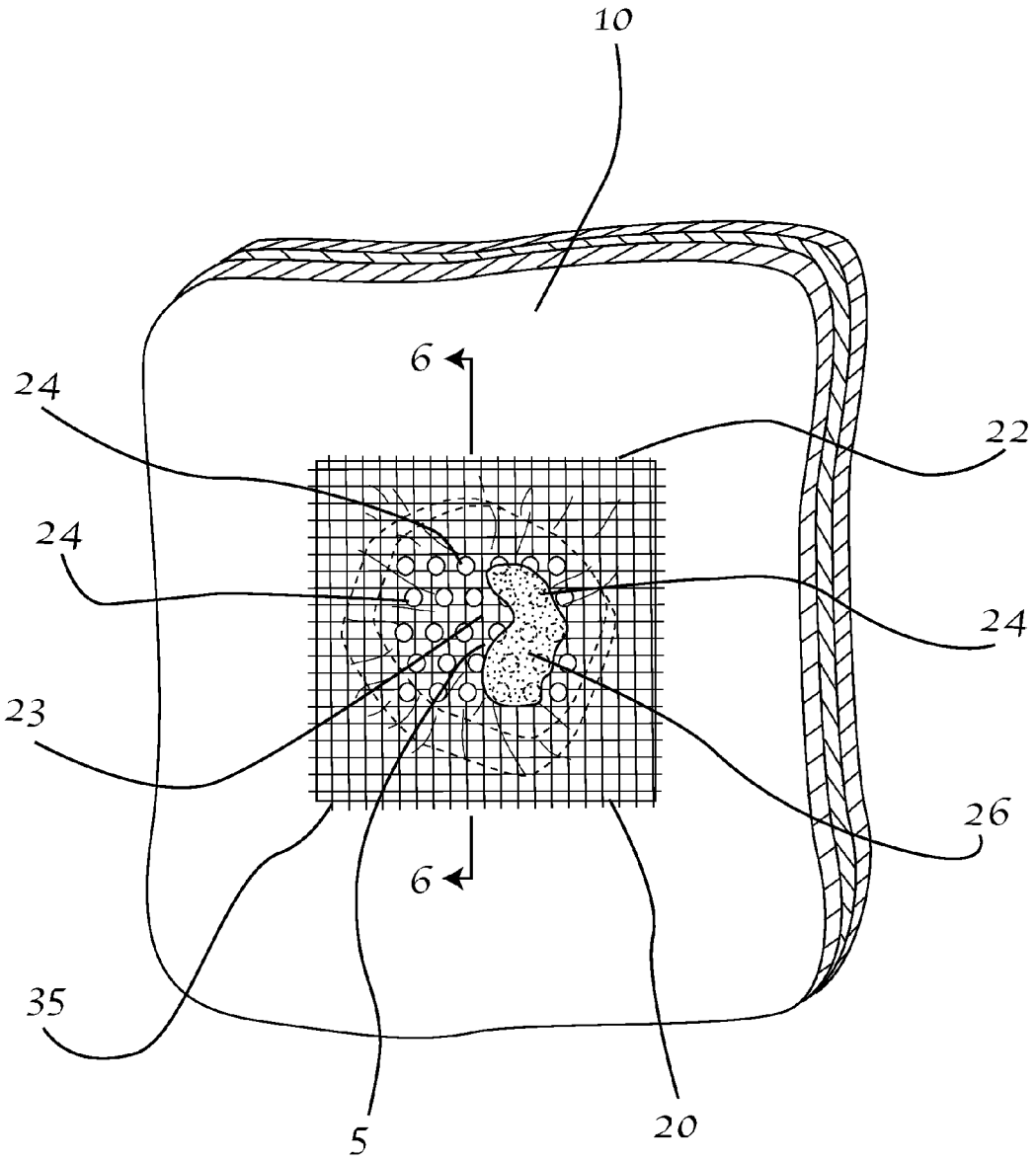
FIG. 5 is an illustration of a perspective view of one embodiment of the invention and shows the patch with a mesh sheet applied to a hole.

FIG. 5 is an illustration of a perspective view of one embodiment of the invention and shows the patch with a mesh sheet applied to a hole. As shown in FIG. 5, the surface repair patch is preferably comprised of a patch 20, adhesive 22, indent 23, perforations 24, cement compound 26, and mesh sheet 35. Patch 20 preferably covers over hole 5. Like the patch 20, the mesh sheet 35 typically includes perforations 24 configured to receive a cement compound 26. When the cement compound 26 is applied onto patch 20, patch 20 becomes indented into the hole 5 from natural pressure commonly created from a drywall knife, forming an indent 23. Alternatively, a user may form an indent 23 by indenting the partially rigid patch 20. After patch 20 has been indented and sets hard, a drywall compound 30 (shown in FIG. 7) is typically administered over the mesh sheet 35 and patch 20 to complete the repair of the hole. As discussed above, the indented patch allows a smoother, faster, and better repair on the hole to be performed. The mesh sheet 35 provides valuable strength to the patch 20.

Figure 6:
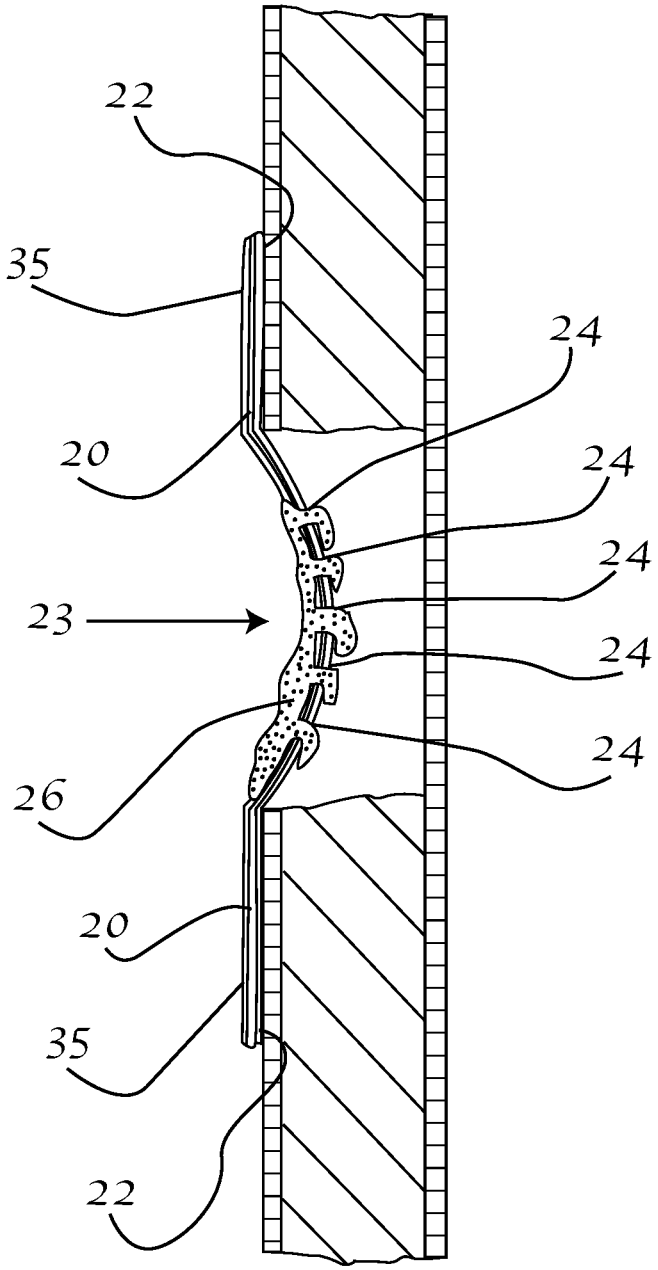
FIG. 6 is an illustration of a cross-section view of one embodiment of the invention with a mesh sheet and shows the patch indented after application of the drywall compound.

FIG. 6 is an illustration of a cross-section view of one embodiment of the invention with a mesh sheet and shows the patch indented after application of the drywall compound. As shown in FIG. 6, the repair patch is preferably comprised of: a patch 20, adhesive 22, indent 23, perforations 24; cement compound 26; and mesh sheet 35. Both the patch 20 and mesh sheet 35 are affixed to the wall 10 via an adhesive 22. Specifically, patch 20 is preferably adhesively affixed to the front side of the wall 10, but any fastening means may be used, and mesh sheet 35 is affixed to patch 20. Although FIG. 6 shows that the mesh sheet 35 typically extends beyond patch 20 to provide additional adhesive binding to the wall 10, the mesh sheet 35 may be smaller than patch 20 or the same size without deviating from the scope of the invention. Additionally, mesh sheet 35 and patch 20 may be provided as a single part or may be separate and then later combined. Mesh sheet 35 and patch 20 may be connected to each other via any adhesive, fastening mechanism, or binding mechanism.

FIG. 6 also shows the patch 20 and mesh sheet 35 indented into the hole 5 and held there via cement compound 26. The cement compound 26 is administered onto and through both the patch 20 and mesh sheet 35, and, as a result, portions of the drywall compound 30 preferably seep through the perforations 24 of the mesh sheet 35 and patch 20. Once the cement compound 26 is applied, the center portion of the patch 20 becomes indented into the hole 5 to form a solid indentation 23. Alternatively, a user may push the center portion of the more rigid patch 20 into the hole 5 to form an indent 23 as the cement compound 26 sets or hardens.

Figure 7:
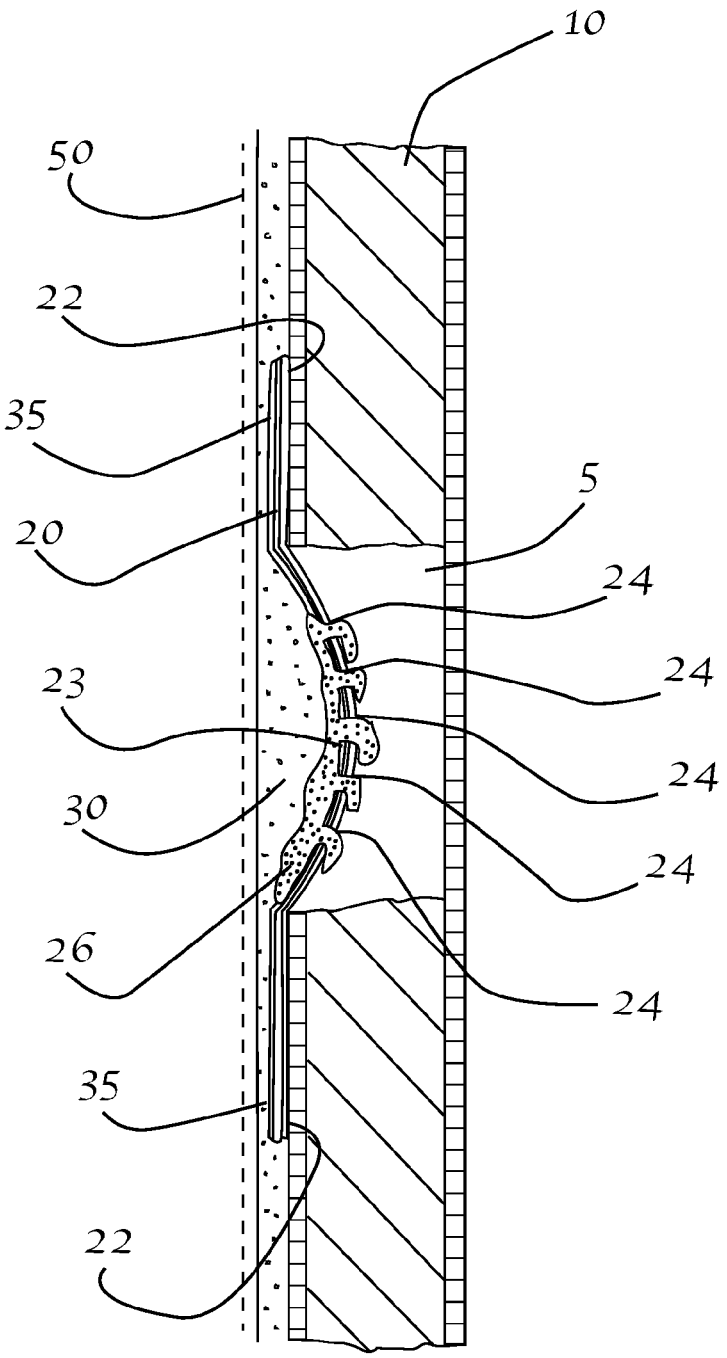
FIG. 7 is an illustration of a cross-section view of one embodiment of the invention with a mesh sheet and shows the patch indented and after application of the drywall compound.

FIG. 7 is an illustration of a cross-section view of one embodiment of the invention with a mesh sheet and shows the patch indented and after application of the drywall compound. As shown in FIG. 7, the invention for a perforated surface repair patch is preferably comprised of: a patch 20, adhesive 22, indent 23, perforations 24, cement compound 26, drywall compound 30, and mesh sheet 35. FIG. 7 shows how a drywall compound 30 may be smoothly applied to hole 5, completely repairing hole 5. The drywall compound 30 is typically applied and layered over the patch 20, and the preferably sanded down to be smooth with the rest of the wall. Additionally, a layer of paint 50, which is not part of the claimed invention and is shown in broken-line form, may be applied over the smooth drywall compound to complete the repair.

Figure 8:
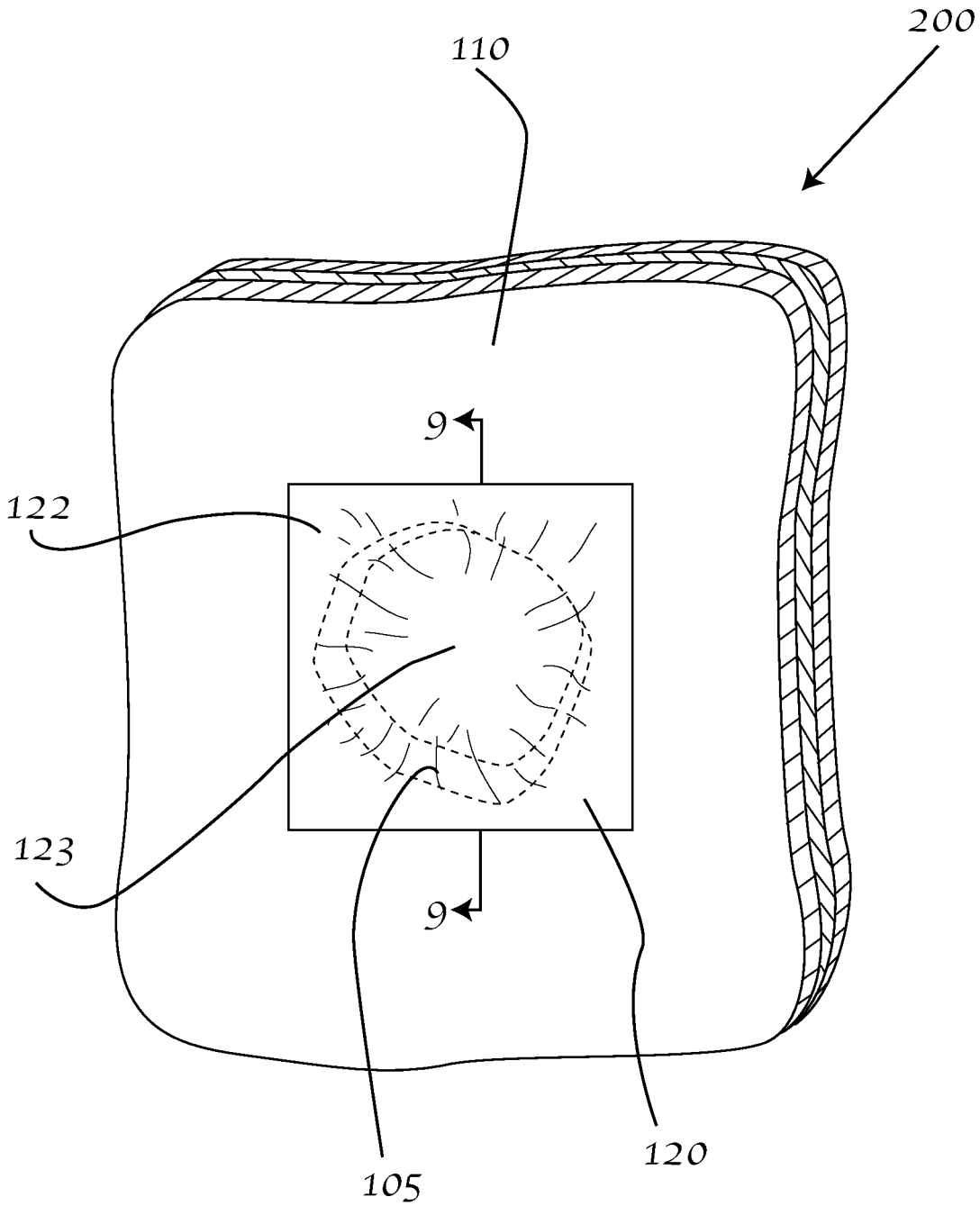
FIG. 8 is an illustration of a perspective view of another embodiment of the invention and shows the patch without perforations applied to a hole.

FIG. 8 is an illustration of a perspective view of another embodiment of the invention and shows the patch without perforations applied to a hole. As shown in FIG. 8, one embodiment of the invention may be a surface repair patch without perforations 200 for a hole 105 in wall 110 and may be comprised of a patch 120, adhesive 122, and indent (or indented portion) 123. The patch 120 is preferably a small piece of material affixed to a wall to conceal, reinforce, or repair a worn area, hole, or tear. The patch 120 may be constructed of any pliable, semi-rigid, or rigid material such as cloth, foil, latex, textile fibers, polymers, folded and/or expandable aluminum, and the like. Patch 120 is adhered, or otherwise affixed or attached to the front surface, although any surface may be repaired, of the wall 110 along the outer edge or surface of the hole 105. Generally, a pressure sensitive adhesive is the preferred method to adhere, affix, attach, or connect the patch onto the wall or surface to be repaired, but it should be understood that any attachment or connection means may be used. FIG. 8 shows how the indented portion 123 holds an indented shape due to the semi-rigid or poseable nature of the patch material. Typically, the indent 123 is created by the user pushing the patch 120 gently into the hole 105 such that the patch 120 is not unmoored from the wall or surface 110 and not torn or punctured. However, an indenting tool may be used without deviating from the scope of the invention.

Figure 9:
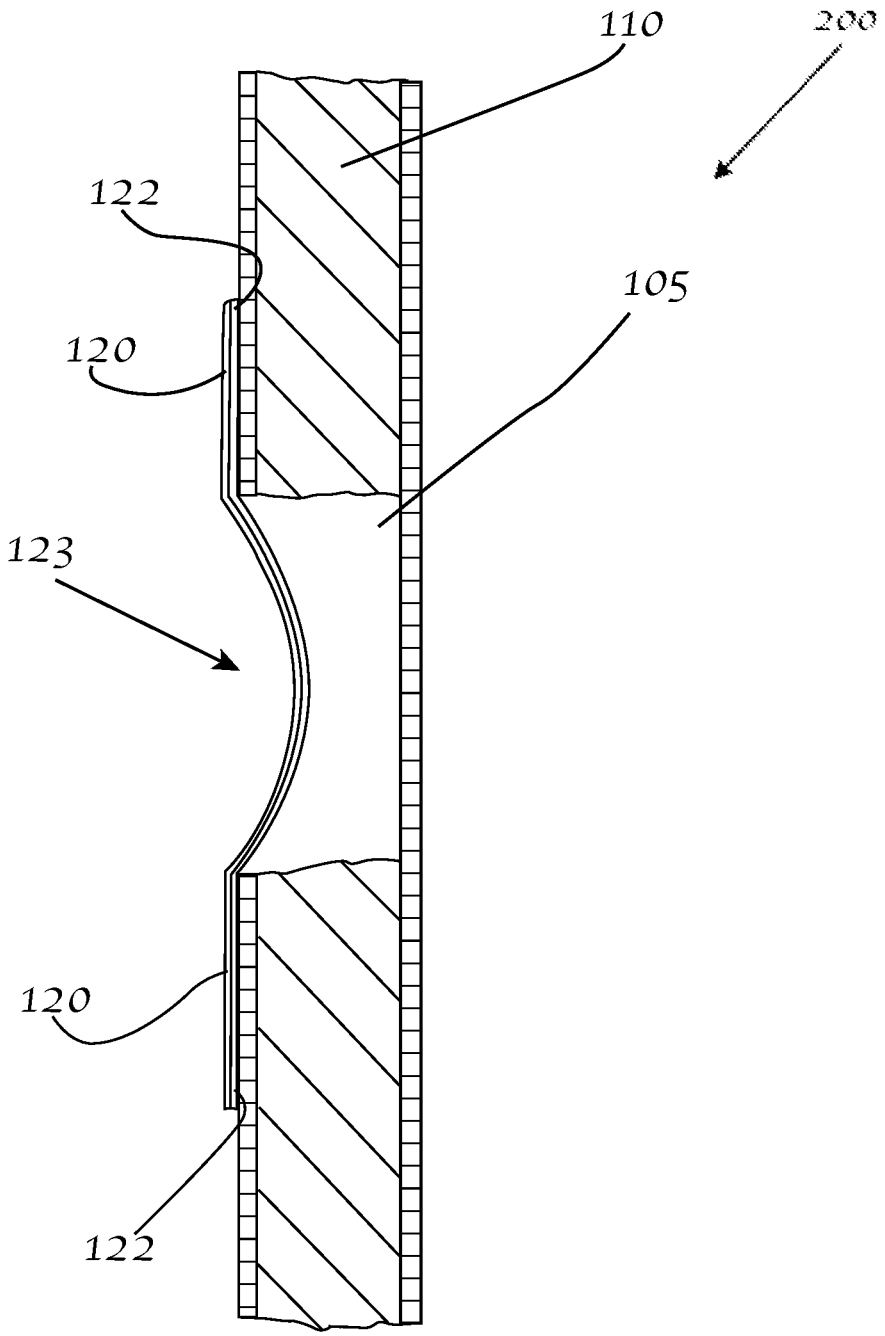
FIG. 9 is an illustration of a cross-sectional view of another embodiment of the invention without a mesh sheet and shows the indented patch without perforations.

FIG. 9 is an illustration of a cross-sectional view of another embodiment of the invention without a mesh sheet and shows the patch without perforations indented. As shown in FIG. 9, the surface repair patch without perforations 200 is preferably comprised of: a patch 120, adhesive 122, and indent (or indented portion) 123. FIG. 9 shows how the patch 120 is affixed to the wall 110 via adhesive 122. Patch 120 is preferably adhesively affixed to the front side of the wall 110, but any fastening mechanism may be used, including mechanical fastening mechanisms, such as pins, nails, or staples. FIG. 9 shows how the indented portion 123 holds an indented shape due to the semi-rigid or poseable nature of the patch material.

Figure 10:
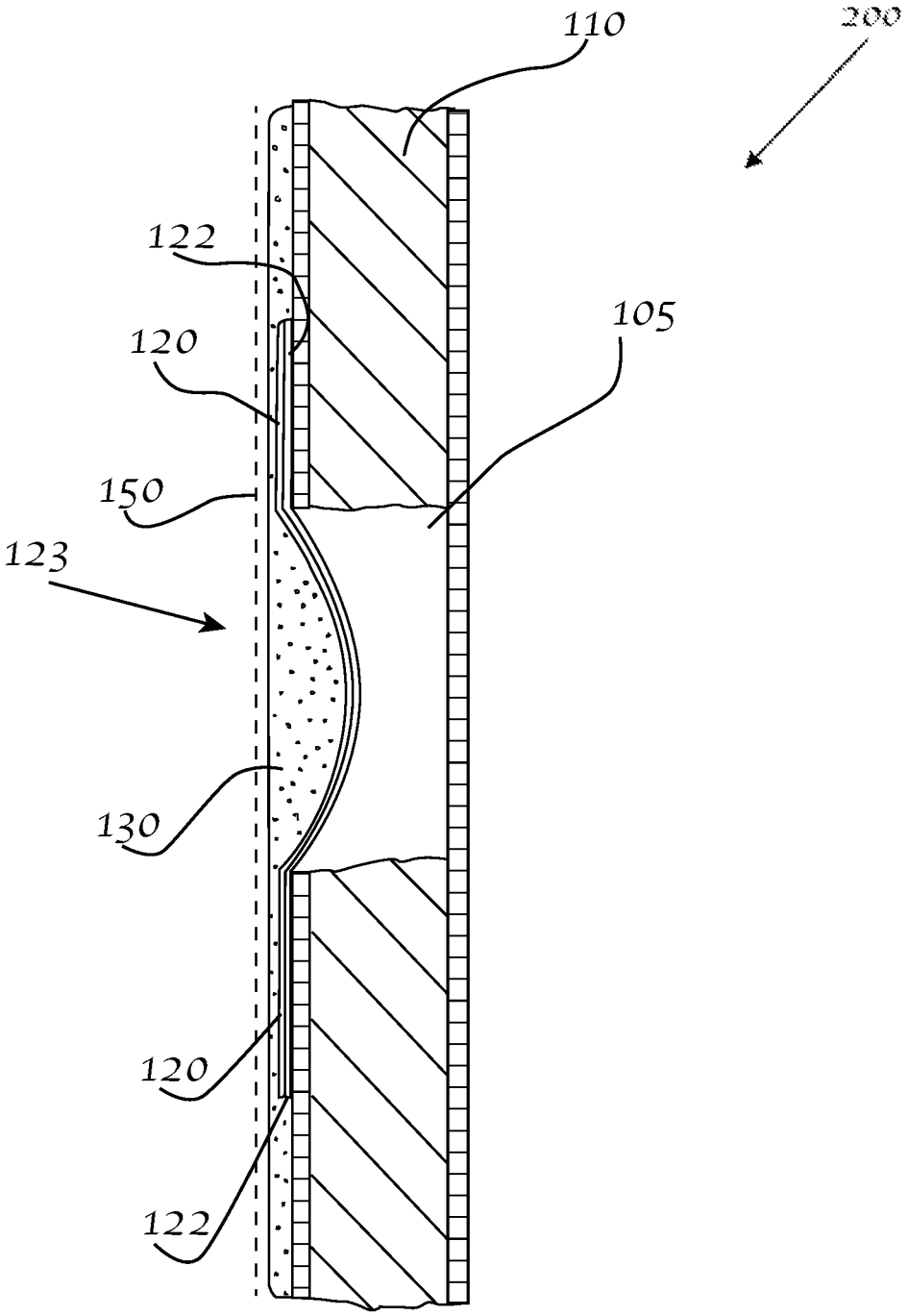
FIG. 10 is an illustration of a cross-sectional view of another embodiment of the invention without a mesh sheet and shows the patch without perforations indented after application of the drywall compound.

FIG. 10 is an illustration of a cross-sectional view of another embodiment of the invention without a mesh sheet and shows the patch indented after application of the drywall compound. As shown in FIG. 10, the surface repair patch without perforations 200 is preferably comprised of: a patch 120, adhesive 122, indent 123, and drywall compound 130. FIG. 10 also shows how a drywall compound 130 may be smoothly applied to cover and repair hole 105. The drywall compound 130 preferably fills indent 123 when applied and is smoothed flush with the outer surface of wall 110. Typically, a layer of paint 150, which is not part of the claimed invention and is shown in broken-line form, is applied over the smooth drywall compound to complete the repair.

Figure 11:
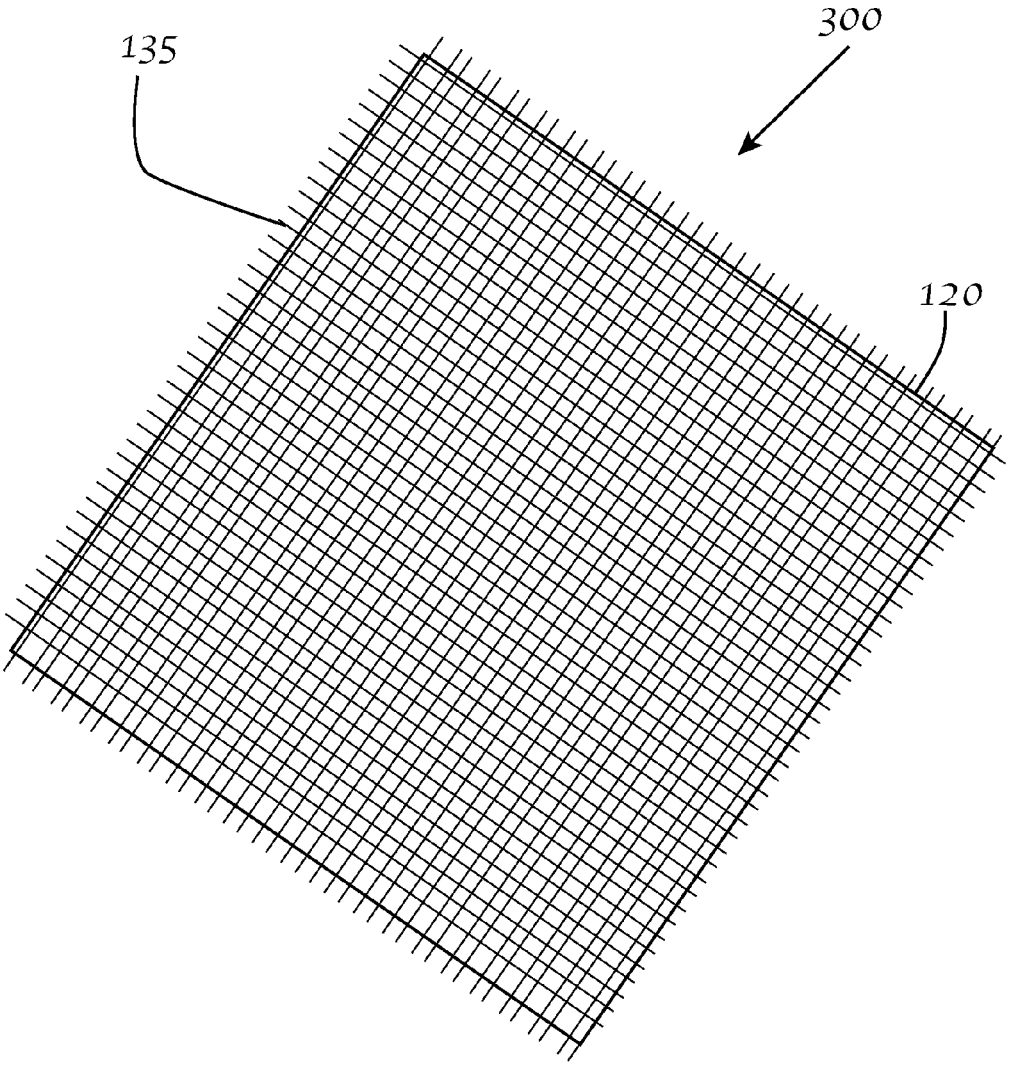
FIG. 11 is an illustration of a perspective view of another embodiment of the patch without perforations but with a mesh sheet and shows mesh sheet affixed to the patch.

FIG. 11 is an illustration of a perspective view of another embodiment of the patch without perforations but with a mesh sheet and shows mesh sheet affixed to the patch. As shown in FIG. 11, the patch 300 (which is not perforated) preferably includes: a patch 120 and mesh sheet 135. The patch 120, as discussed above, is preferably constructed out of a thin pliable sheet or foil type material, such as aluminum, but may be constructed out of any other natural, synthetic, or man-made or non-manmade material. The mesh sheet 135 is preferably constructed of mesh, net, fiber, or fiberglass material and typically contains a permanent adhesive to adhere, affix, attach, or connect itself to the patch 120 and/or onto the wall or surface to be repaired. However, the mesh sheet 135 may be affixed via any mechanism, and may be made of any material such as solid non-mesh material without deviating from the scope of the invention. The patch 300 may also include additional layers such as a stretchable plastic and/or adhesive. The mesh sheet 135 is typically affixed to the patch 120 to provide additional support for the drywall compound 130 to help minimize cracking, and in a non-limiting example, mesh sheet 135 may also be drywall tape, tape, or reinforced tape. While FIG. 11 shows a patch 120 with a mesh sheet 135, it should be understood that the present invention allows the use of a patch 120 without utilizing a mesh sheet 135.

Figure 12:
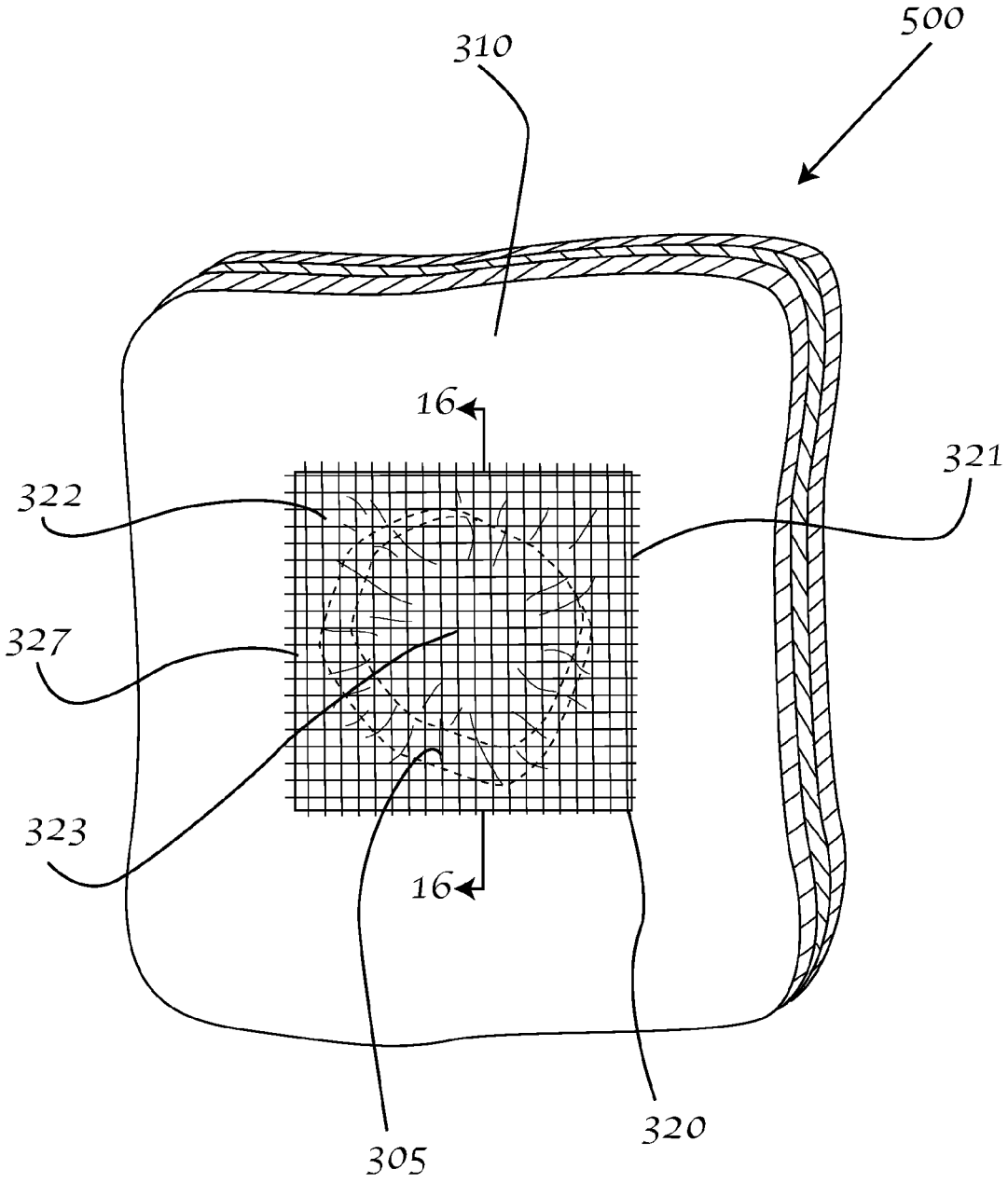
FIG. 12 is an illustration of a perspective view of a preferred embodiment of the invention and shows the patch with a mesh sheet, foil, and stretchable plastic film applied to a hole.

FIG. 12 is an illustration of a perspective view of a preferred embodiment of the invention and shows the patch with a mesh sheet, foil, and stretchable plastic film applied to a hole. As shown in FIG. 12, a preferred embodiment of the invention may be a surface repair patch 500 for a hole 305 in wall 310 and may be comprised of a patch 320, adhesive 322, and indent (or indented portion) 323. The patch 320 is preferably a small piece of material that consists of several layers and is preferably affixed to a wall to conceal, reinforce, or repair a worn area, hole, or tear. Each of the layers of the patch 320 may be constructed of any pliable, semi-rigid, or rigid material such as cloth, foil, latex, textile fibers, polymers, expandable aluminum foil, aluminum, aluminum foil, stretchable plastic (e.g., saran wrap), and the like. For example, one embodiment of the patch 320 may consist of three layers—a mesh sheet 321, foil 327, and stretchable plastic film 328 (shown in FIG. 13 and FIG. 14); wherein the mesh sheet 321 may be the top layer, the foil 327 is the middle layer, and the stretchable plastic film 328 is the bottom layer. Alternatively, the mesh sheet 321 may also substantially cover a first side (preferably front side) of the foil 327, and the stretchable plastic film 328 may be affixed to and/or substantially cover a second side (preferably back side) of the foil 327. The mesh sheet 321 is preferably constructed of fiberglass mesh and is preferably used to help prevent the patch 320 from cracking after a repair has been made. The foil 327 is preferably a metal or aluminum metal with a thickness of approximately between 0.02 to 0.04 inches but may consist of a thickness between 0.000001 to 0.1 inches. The stretchable plastic film 328 may be constructed of any plastic polymer or wrap such as Saran® wrap and preferably includes an adhesive for attaching onto a surface. The patch 320 is adhered, or otherwise affixed or attached, to the front surface, although any surface may be repaired, of the wall 310 along the outer edge or surface of the hole 305. Generally, a pressure sensitive adhesive located on the stretchable plastic is the preferred method to adhere, affix, attach, or connect the patch 320 onto the wall or surface to be repaired, but it should be understood that any attachment or connection means may be used. FIG. 12 shows how the indented portion 323 holds an indented shape due to the semi-rigid or poseable nature of the patch material. Typically, the indent 323 is created by the user pushing the patch 320 gently into the hole 305 such that the patch 320 is not unmoored from the wall or surface 310 and not torn or punctured. However, an indenting tool may be used without deviating from the scope of the invention. Although FIG. 12 shows a mesh sheet used on the patch, the mesh sheet is not required for attachment of the patch onto the surface of the wall.

Preferably, the surface repair patch 500 is indented at a minimum of ¼ inches. This may be achieved due to the stretchable plastic film 328, which typically allows the foil 327 to contort deeper into the hole 305 without damaging the surface of the wall 310 surrounding the hole 305. The present invention also preferably allows the foil 327 to be several times thicker than a standard aluminum foil.

Figure 13:
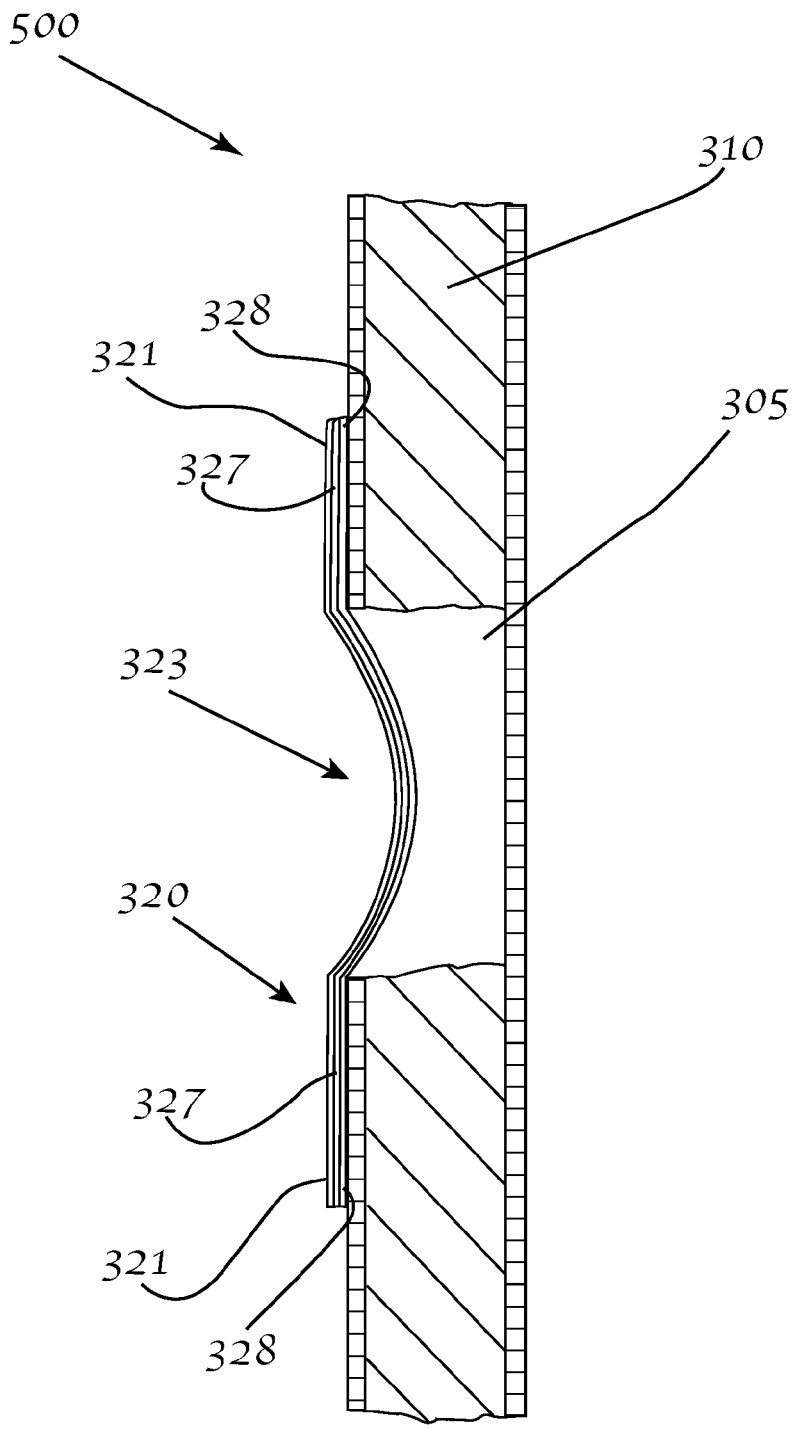
FIG. 13 is an illustration of a cross-sectional view of another preferred embodiment of the invention and shows the indented patch with a mesh sheet, foil, and stretchable plastic film.

FIG. 13 is an illustration of a cross-sectional view of another preferred embodiment of the invention and shows the indented patch with a mesh sheet, foil, and stretchable plastic film. As shown in FIG. 13, a preferred embodiment of the surface repair patch 500 is preferably comprised of: a patch 320, and indent (or indented portion) 323. The patch 320 preferably includes a mesh sheet 321, foil 327, and stretchable plastic film 328. The stretchable plastic film 328 preferably includes an adhesive. FIG. 13 shows how the patch 320 is affixed to the wall 310 via the stretchable plastic film 328 with adhesive. Patch 320 is preferably adhesively affixed to the front side of the wall 310, but any fastening mechanism may be used, including mechanical fastening mechanisms, such as pins, nails, or staples. FIG. 13 shows how the indented portion 323 holds an indented shape due to the semi-rigid or poseable nature of the patch material.

Figure 14:
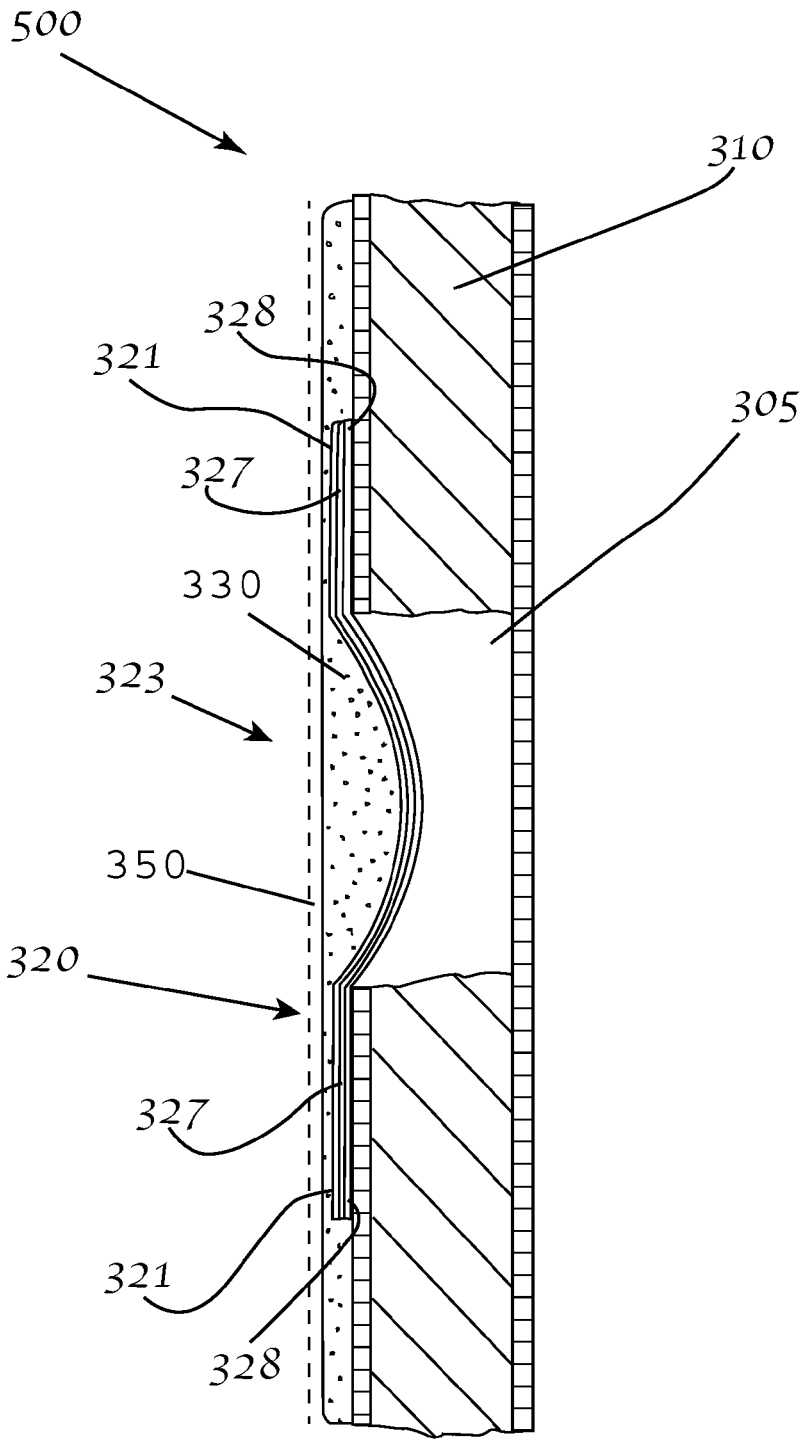
FIG. 14 is an illustration of a cross-sectional view of another embodiment of the invention and shows the patch with a mesh sheet, foil, and stretchable plastic film indented after application of the drywall compound.

FIG. 14 is an illustration of a cross-sectional view of another embodiment of the invention and shows the patch with a mesh sheet, foil, and stretchable plastic film indented after application of the drywall compound. As shown in FIG. 14, a preferred embodiment of the surface repair patch 500 is preferably comprised of: a patch 320, indent 323, and drywall compound 330. The patch 320 preferably includes a mesh sheet 321, foil 327, and stretchable plastic film 328. FIG. 14 also shows how a drywall compound 330 may be smoothly applied to cover and repair hole 305. The drywall compound 330 preferably fills indent 323 when applied and is smoothed flush with the outer surface of wall 310. Typically, a layer of paint 350, which is not part of the claimed invention and is shown in broken-line form, is applied over the smooth drywall compound to complete the repair.

Another embodiment of the invention may be a surface repair patch constructed with expandable material for a hole in the wall and may be comprised of a patch and adhesive. The patch is preferably a small piece of expandable material, preferably constructed of expandable aluminum foil, affixed to a wall to conceal, reinforce, or repair a worn area, hole, or tear. The patch is adhered, or otherwise affixed or attached, to the front surface, although any surface may be repaired, of the wall along the outer edge or surface of the hole. Generally, a pressure sensitive adhesive is the preferred method to adhere, affix, attach, or connect the patch onto the wall or surface to be repaired, but it should be understood that any attachment or connection means may be used. The expandable material is preferably an aluminum foil that is folded into itself to allow the relatively rigid aluminum foil to be expanded by opening, or expanding, on the folds.

Another embodiment of the invention may be a surface repair patch constructed with expandable material, which may be comprised of: a patch, adhesive, and indent. The patch may be affixed to the wall via adhesive. The patch is preferably adhesively affixed to the front side of the wall, but any fastening mechanism may be used, including mechanical fastening mechanisms, such as pins, nails, or staples. Preferably, the patch is indented into the wall, such that the expandable material of the patch unfolds, creating and indented space for application of drywall compound or any surface repair compound material.

Another embodiment of the invention may be a surface repair patch constructed with expandable aluminum foil, which is preferably comprised of: a patch, adhesive, indent, and drywall compound. The drywall compound may be smoothly applied to indent, repairing hole, and preferably covers the patch smoothly when applied, and typically, a layer of paint, which is not part of the claimed invention, is applied over the smooth drywall compound to complete the repair.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A surface repair patch comprising:

a patch;

wherein said patch is affixed to an outer edge of a hole in a surface, such that said patch substantially covers said hole;

wherein said patch indents into said hole such that an indented portion of said patch is created; and wherein said indented portion of said patch remains substantially indented when a user applies a drywall compound to fill said indented portion;

wherein said patch is constructed of foil.

2. The surface repair patch of claim 1, wherein said patch includes an adhesive on at least one side of said patch.

3. The surface repair patch of claim 2, further comprising a mesh sheet;

wherein said mesh sheet is affixed to and substantially covers said patch.

4. A surface repair patch comprising:

a patch;

wherein said patch is affixed to an outer edge of a hole in a surface, such that said patch substantially covers said hole;

wherein said patch indents into said hole such that an indented portion of said patch is created; and wherein said indented portion of said patch remains substantially indented when a user applies a drywall compound to fill said indented portion;

wherein said patch comprises of: a mesh sheet; a foil; and a stretchable plastic film;

wherein said mesh sheet is affixed to and substantially covers a first side of said foil; and wherein said stretchable plastic film is affixed to and substantially covers a second side of said foil.

5. The surface repair patch of claim 4, wherein said stretchable plastic film includes an adhesive; and wherein said adhesive affixes said patch onto said surface.

6. The surface repair patch of claim 5, wherein said mesh sheet is constructed out of a fiberglass thread material.

7. The surface repair patch of claim 6, wherein a thickness of said foil is approximately between 0.02 to 0.04 inches.

8. A surface repair patch comprising:

a patch; and a mesh sheet;

wherein said patch is affixed to an outer edge of a hole in a surface, such that said patch substantially covers said hole; and wherein said patch indents and remains substantially indented when a user applies a cement compound onto said patch;

wherein said patch includes one or more perforations;

wherein said one or more perforations receive said cement compound, such that a portion of said cement compound passes through said one or more perforations;

wherein said mesh sheet is affixed to and substantially covers said patch;

wherein said patch is constructed out of a pliable sheet material;

wherein said mesh sheet is constructed out of a fiberglass thread material;

wherein said patch includes an adhesive on at least one side of said patch; and wherein said patch is an aluminum foil.

9. A method of applying a repair patch to a hole in a surface, comprising the steps of:

affixing a patch to an outer edge of a hole in a surface, such that said patch substantially covers said hole;

wherein said patch includes one or more perforations;

applying a cement compound to said patch, such that said cement compound passes through said one or more perforations; and indenting said patch by pushing said patch into said hole;

wherein said patch is an aluminum foil.

* * * * *